United States Patent [19]

Mizutani

[11] 4,140,408

[45] Feb. 20, 1979

[54] PUSH TYPE MECHANICAL PENCIL

[75] Inventor: Satoshi Mizutani, Tokyo, Japan

[73] Assignee: Pentel Kabushiki Kaisha, Tokyo, Japan

[21] Appl. No.: 824,951

[22] Filed: Aug. 15, 1977

[30] Foreign Application Priority Data

Aug. 20, 1976 [JP] Japan ..... 51/99381
Aug. 8, 1977 [JP] Japan ..... 52/105969[U]

[51] Int. Cl.[2] ..... B43K 21/22

[52] U.S. Cl. ..... 401/65; 401/87; 401/89; 401/94

[58] Field of Search ..... 401/88, 89, 92-94, 401/86, 87, 65, 67

[56] References Cited

U.S. PATENT DOCUMENTS

| | | | |
|---|---|---|---|
| 1,291,671 | 1/1919 | Roll | 401/92 |
| 1,296,011 | 3/1919 | Roll | 401/93 |
| 3,945,733 | 3/1976 | Edel | 401/94 |

FOREIGN PATENT DOCUMENTS

| | | | |
|---|---|---|---|
| 496304 | 10/1950 | Belgium | 401/93 |

*Primary Examiner*—Clifford D. Crowder

*Attorney, Agent, or Firm*—Wenderoth, Lind & Ponack

[57] ABSTRACT

A push type mechanical pencil having an inner cylinder made of a synthetic resin including a chuck portion and a spare leads containing tube portion communicating with the chuck portion. An integrally molded inner cylinder unit is provided which has a hollow cylindrical body constituting a part of the spare leads containing tube portion, a plurality of longitudinally extending tube forming members which when they are placed together constitute the remaining part of the spare leads containing tube portion, and a plurality of longitudinally separated chuck members which when they are put together constitute the chuck portion. The tube forming members are integrally connected with each other by means of at least a bendable connector portion, and one of the tube forming members is integral with the hollow cylindrical body. Each of the separate chuck members is integral a corresponding one of the tube forming members. The inner cylinder is provided on the outer surface thereof with at least one protrusion, and a barrel is provided on an inner surface thereof with an annular projection. The protrusion and the projection engage each other when the inner cylinder is mounted in the barrel.

7 Claims, 16 Drawing Figures

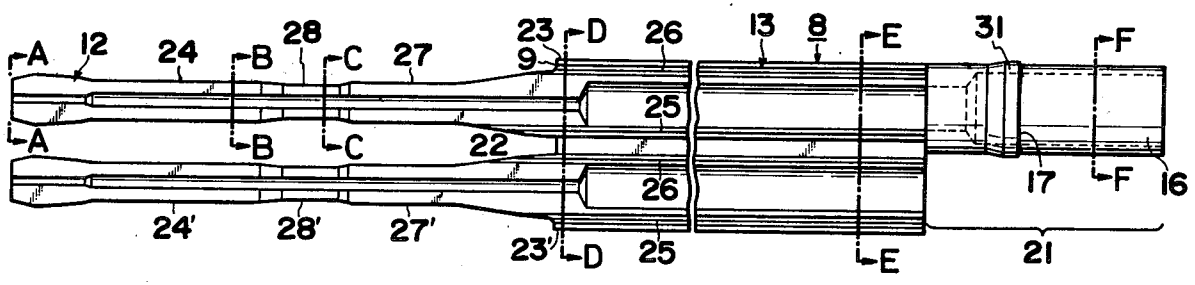
FIG. 3
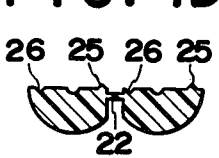
FIG. 4D
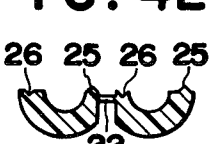
FIG. 4E
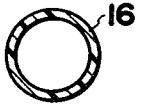
FIG. 4F
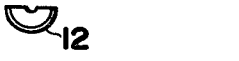
FIG. 4B
FIG. 4A
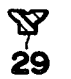
FIG. 4C
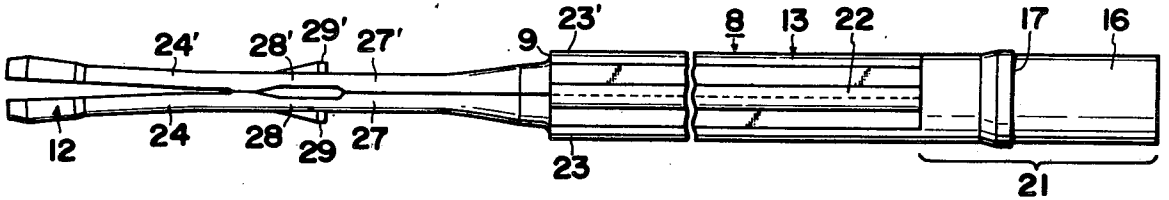
FIG. 5

PUSH TYPE MECHANICAL PENCIL

BACKGROUND OF THE INVENTION

The present invention relates to an improvement in a push type mechanical pencil having an inner cylinder integrally molded of a synthetic resin, the inner cylinder comprising a chuck portion for intermittently pushing out a lead in cooperation with a clamping ring slidably inserted between the front end of a barrel and a ferrule fixed to the front end of the barrel, and a spare leads containing tube portion communicating with the chuck portion.

Molding the inner cylinder of a synthetic resin is advantageous in that it can be made very easily and inexpensively as compared with a metallic inner cylinder made by combining several parts together. It is further advantageous in that it makes the assembly of the mechanical pencil easier and increases the reliability of the operation thereof.

A mechanism and operation of a conventional prior art push type mechanical pencil are as follows: secure retention of a lead to prevent it from retracting due to the writing pressure can be attained by chuck means cooperating with clamping means. Namely, an inner cylinder is biassed by a compression spring fitted in a barrel so as to engage the outer surface of conical members of a chuck portion with the inner surface of a clamping ring to cause the conical members surrounding the outer surface of the lead to squeeze inwardly, thereby pressing against the lead to retain the lead. The lead is pushed out a predetermined amount by pushing the rear end portion of the inner cylinder downwardly against the bias of the spring, so that the clamping ring with the chuck portion is advanced downwardly a predetermined distance, while tightly engaging the lead. When the inner cylinder, or the chuck portion is further advanced even after the clamping ring has been stopped by a stepped portion of a ferrule, the chuck portion releases the lead, and the conical members of the chuck portion are spread apart from one another due to their own elasticity. When the pushing force on the rear end portion of the inner cylinder is removed, the clamping ring is again engaged with the inner cylinder, or the spread conical members and is retracted by the force of the spring. At the time when the retracting movement of the clamping ring is stopped by a stepped portion of the barrel, the above-described firm engagement between the chuck portion and the lead is established again.

There is already known in the prior art an inner cylinder having a chuck portion molded of a synthetic resin consisting of several longitudinally separated structural units. For example, U.S. Pat. No. 3,945,733 discloses an embodiment which has an inner cylinder separated into two structural units, and Japanese Utility Model Laid-open Specification No. 51-59642 discloses an embodiment which has an inner cylinder separated into three structural units. In both of these two cylinders, an annular projection is provided on the inner surface of the barrel and the compression spring is seated on one end surface of the annular projection and the clamping ring contacts the other end surface of the annular projection, and the separated structural units are then forced through the spring and the annular projection into the clamping ring one by one to assemble a complete inner cylinder. The thus assembled inner cylinder is held by the clamping ring since the outer surface of conical members of the chuck portion is engaged with the inner surface of the clamping ring, even when the inner cylinder is biased by the spring.

The prior art push type mechanical pencil of having the construction as above described causes some inconveniences which will be described below. First, the inner cylinder may slip out of the rear end opening of the barrel. The inner cylinder biased by the spring is prevented from slipping out of the barrel only by the engagement of the conical outer surface of the chuck portion with the inner surface of the clamping ring. Therefore, the easier the assembly of the inner cylinder by forcing the separated structural units into the clamping ring one by one, the more the possibility that the inner cylinder will slip out of the rear end opening of the barrel. It is, however, undesirable that an additional member be provided, for example, at the rear end of the barrel to prevent the inner cylinder from slipping out since the number of parts increases. Secondly, the separate structural units once assembled to form the complete inner cylinder may slide relative to each other during the use of the mechanical pencil. These several separate structural units are combined to form the inner cylinder merely by bundling them inside the clamping ring; they are not united, for example, by using an adhesive or the like. Therefore, for example, when only one specific structural unit of the inner cylinder is pushed by the end of the spring by chance, then only that unit may slide with respect to the other structural units. In such a case, it is inevitable that the structural unit which has thus moved causes some difficulty in the functioning of the mechanical pencil.

SUMMARY OF THE INVENTION

An object of the present invention is, therefore, to provide a push type mechanical pencil having an inner cylinder molded of a synthetic resin, which provides advantageous effects provided due to the molded synthetic resin and eliminates the above-described inconveniences, i.e. the slipping of the inner cylinder out of the barrel and the sliding of one of the longitudinally separate structural units forming the complete inner cylinder with respect to the other structural units.

In the present invention, there is provided a push type mechanical pencil which comprises a barrel, an inner cylinder made of a synthetic resin and including a chuck portion and a spare leads containing tube portion communicating with the chuck portion through a lead passage, and a compression spring biasing the inner cylinder rearwardly along its axis. According to the present invention, the inner cylinder is a hollow molded cylindrical body constituting a part of the spare leads containing tube portion, a plurality of individual longitudinally extending tube forming members which, when they are placed together constitute the remaining part of the spare leads containing tube portion, and a plurality of longitudinally separated chuck members which, when they are placed together, constitute the chuck portion. The tube forming members are integrally connected with each other by means of at least a bendable connector portion, and one of the tube forming members is integral with the hollow molded cylindrical body. Each of the chuck members is integral with a corresponding one of the tube forming members. The cylindrical body, the tube forming members and the chuck portion can therefore be integrally molded as a single unit. The inner cylinder is provided at an outer surface thereof with at least one protrusion, and the barrel is provided on an inner surface thereof with an annular projection. The inside diameter of the annular projection is less than the maximum outside diameter of the inner cylinder is at the position of the protrusion, so that the protrusion is adapted to engage the annular projection on the barrel when the inner cylinder is mounted in the barrel.

Other objects and advantages of the present invention will be apparent from the following description when taken in conjunction with the accompanying drawings.

BRIEF DESCRIPTION OF THE DRAWINGS

FIG. 3 is a bottom plan view of the inner cylinder unit shown in FIG. 2;

FIGS. 4A to 4F are end and cross-sectional views taken along lines A—A through F—F in FIG. 3;

FIG. 5 is a side elevational view of the inner cylinder unit shown in FIGS. 2 and 3 in the assembled condition;

DESCRIPTION OF THE PREFERRED EMBODIMENTS

Figure 1:
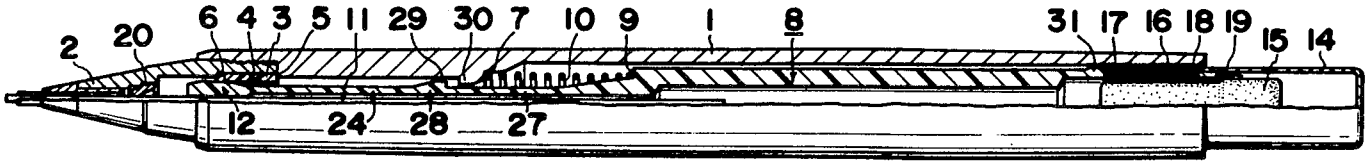
FIG. 1 is a partially sectioned side view showing an embodiment of a mechanical pencil according to the present invention.
Figure 2:
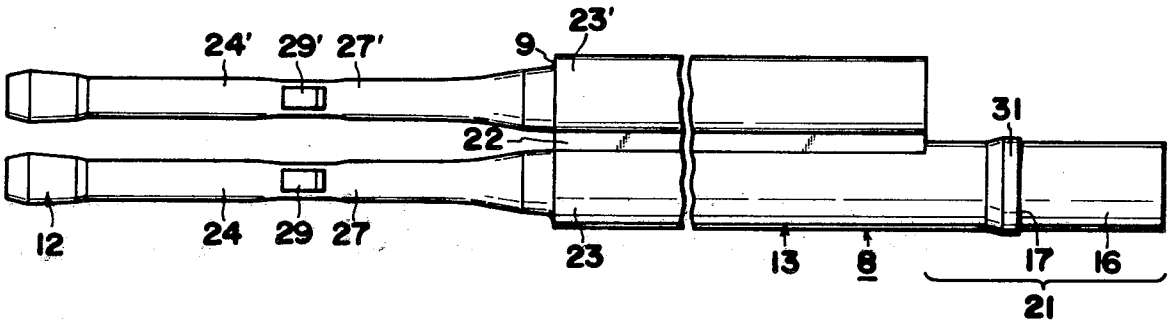
FIG. 2 is a top plan view of an integrally molded inner cylinder with for the pencil shown in FIG. 1 in the unassembled condition.
Figure 6:
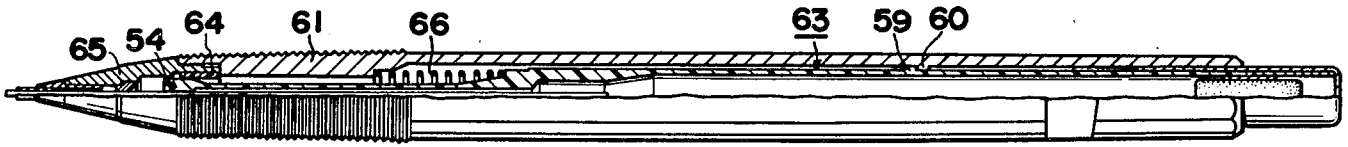
FIG. 6 is a partially sectioned side view showing another embodiment of a mechanical pencil according to the present invention.
Figure 7:
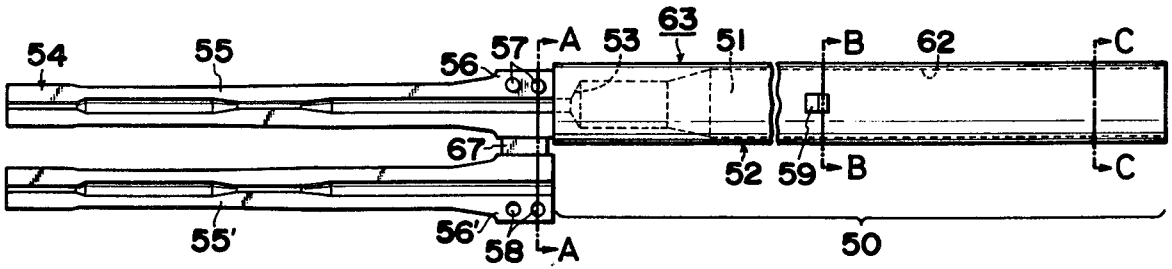
FIG. 7 is a plan view of an integrally molded inner cylinder unit for the pencil shown in FIG. 7, in the unassembled condition.
Figures 8A, 8B, 8C:
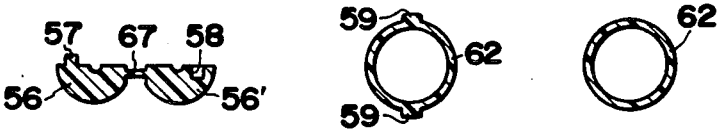
FIGS. 8A–8C are cross-sectional views taken along lines A—A through C—C in FIG. 7.
Figure 9:
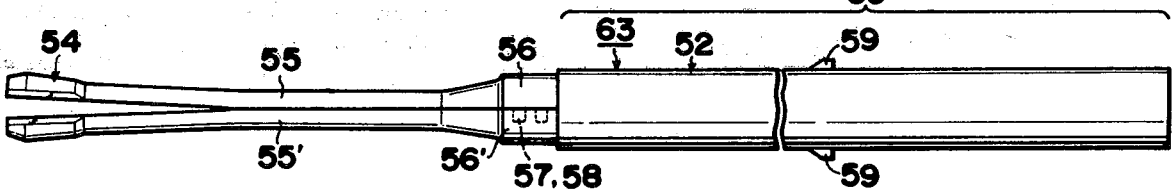
FIG. 9 is a side elevational view of the inner cylinder unit shown in FIG. 7 in the assembled condition.

Referring to FIG. 1, a clamping ring 3 is slidably fitted inside the inner surface 4 of a ferrule 2 fastened to the front end of a barrel 1, so that the clamping ring 3 can slidingly move between an end surface 5 of the barrel 1 and an end surface 6 of the ferrule 2. A compression spring 10 is inserted between a shoulder portion 7 formed on the inner annular surface of the barrel 1 and a shoulder portion 9 formed by a reduced diameter portion an inner cylinder 8. The inner cylinder 8 comprises a chuck portion 12 for firmly holding and releasing a lead 11 in cooperation with the clamping ring 3, a spare leads containing tube portion 13 communicating with the chuck portion 12 through a lead passage, and a rear end portion 16, communicating with the spare leads containing tube 13 and closed by fitting thereinto an eraser 15. A cap 14 is fitted over the end of rear end portion 1*a*. The chuck portion 3, the spare leads containing tube portion 13 and the rear end portion 16 are all molded of a synthetic resin. The cap 14 abuts on a stepped portion 17 on the rear end portion 16 and the eraser 15 is positioned by engagement of a stepped portion of a thin metal cover 18 fitted on the eraser with the end surface of the rear end portion 16, whereby the cap 14 and the eraser 15 are not pushed further inwardly. Inside the ferrule 2 is fitted an annular resilient gasket 20 for preventing retracting movement of the lead 11. The components and the construction as described above are practically the same as those of a conventional prior art mechanical pencil.

The characteristic features of the present invention reside in the construction of the inner cylinder 8, and in order to more clearly describe these inventive features, one embodiment of the present invention is shown in FIGS. 2 to 5. The construction of this inner cylinder 8 is different from that of the previously described prior art wherein a plurality of independent members are bundled together. A portion 21 of the inner cylinder 8, i.e. a part of the tube portion 13 and the whole of the rear end portion 16, of the present invention is a hollow molded cylindrical body (see FIG. 4F). The remaining part of the tube portion 13 is constituted by two longitudinally extending tube forming members 23 and 23' integrally connected to each other by a connector portion 22 which is freely bendable (see FIG. 4D and 4E). The respective tube forming members 23 and 23' have chuck members 24 and 24' integrally formed therewith and which constitute the chuck portion 12 when they are put together. On the opposite faces of the tube forming members 23 and 23' are formed a longitudinally extending projection 25 and a mating groove 26 which are engageable with each other for properly aligning the members 23 and 23' axially to form the inner cylinder 8 when they are put together as shown in FIG. 5. The dimensions of the space between the two tube forming members 23, 23' is so determined that the outer surface of the connector portion 22 bent in a U-shape when the members 23 and 23' are put together as shown in FIG. 5 is within a circle defined by the outer surface of the hollow cylindrical body 21. This causes the members 23 and 23' to be formed into a substantially cylindrical body just like the cylindrical body 21.

The chuck members 24 and 24' respectively have elongated neck portions 27 and 27', at which portions flexible portions 28 and 28' of reduced thickness are respectively provided. Trapezoidal protrusions 29 and 29' are provided on the outer surfaces of the flexible portions 28 and 28'. On the other hand, on the inner surface of the barrel 1 is provided an annular projection 30 which cooperated with the protrusions 29, 29', as shown in FIG. 1. The protrusions 29 and 29' and the annular projection 30 are formed such that the inside diameter of the annular projection is smaller than the maximum outside diameter of the protrusions at the location of the protrusion. It will be clearly understood that the inner cylinder 8 cannot slip out of the rear end of the barrel 1 it has been fixed in the barrel as shown in FIG. 1. To effect such fixing of the inner cylinder 8 in the barrel 1, it is necessary that the protrusions 29 and 29' are forced past the annular projection 30. When the inclined surface of the annular projection 30 presses the inclined surfaces of the trapezoid protrusions 29 and 29', the flexible portions 28, 28', i.e. the protrusions 29 and 29' are easily depressed by the perpendicular component of the pressing force, it is possible to fix the inner cylinder 8 in the barrel 1 by lightly pushing the former into the latter. Thus, the easy fixation of the inner cylinder 8 in the barrel 1 is performed and an irreversible relation between parts is established, since the inner cylinder 8 can no longer slip out of the barrel 1 when the former has once been fixed in the latter.

Further, the hollow molded cylindrical body 21 is provided with an annular projection 31. The outside diameter of the annular projection 31 is substantially equal to the inside diameter of the barrel 1, so that the axis of the inner cylinder 8 is aligned with that of the barrel 1 when the inner cylinder 8 is inserted into the barrel 1. The largent diameter portion of the annular projection 31 also serves as the stepped portion 17 previously referred to.

In assembling the path type mechanical pencil of the present invention, the tube forming members 23 and 23', as well as the chuck members 24 and 24', are put together to form the complete inner cylinder 8 as shown in FIG. 5, and the compression spring 10 is put on the chuck members 24 and 24'. Then, the inner cylinder 8 with the spring 10 thereon is inserted into the barrel 1 through the rear end opening thereof by lightly pushing on the inner cylinder 8. The clamping ring 3 is then inserted from the front end opening of the barrel 1 beyond the conical head of the chuck portion 12. The ferrule 2, the cap 14 and eraser 15 are thereafter fixed in their positions as shown in FIG. 1. The actions for the use of this mechanical pencil are the same as those for a conventional one and, therefore, the description of the use of the thus assembled mechanical pencil is omitted.

FIGS. 6 to 9 show another embodiment of the present invention, in which the hollow molded cylindrical body 50 has a spare leads containing chamber 51 provided in the spare leads containing tube portion 52. An inclined bottom surface 53 of the chamber 51 functions to deliver the leads one by one to the chuck portion 54 constituted by the chuck members 55 and 55'. Therefore, in the first embodiment as shown in FIGS. 1 to 5, the tube forming members 23 and 23' have to be put together precisely to form a spare leads containing chamber having a smooth bottom surface. According to the second embodiment as shown in FIGS. 6 to 9, on the other hand, it is easy to provide the smooth bottom surface 53 of the chamber 51, since the bottom portion of the chamber 51 is included within the hollow molded cylindrical body 50, so that it is not longitudinally divided. In order to cause the tube forming members 56 and 56' to meet precisely when they are put together, projections 57 and holes 58 are formed at corresponding positions in the opposed faces. In this embodiment, there are provided protrusions 59 on the outer surface of the hollow molded cylindrical body 50, which are engaged with an annular projection 60 formed on the inner surface of the barrel 61 (see FIG. 6). In this case, the protrusions 59 be depressible due to the flexibility of the relatively thin wall 62 of the chamber 51. Other components and the construction of the second embodiment shown in FIGS. 6 to 9, such as the inner cylinder 63, the clamping ring 64, the ferrule 65, the compression spring 66, the connector portion 67 and the like, are substantially the same as those in the first embodiment shown in FIGS. 1 to 5, and, therefore, a detailed description thereof is omitted.

The mechanical pencil according to the present invention having the construction as hereinbefore described, achieves advantageous effects as will be described below. The inner cylinder 8 or 63 itself can be made of an integrally molded unit of synthetic resin, so that it is not required to combine several parts together. As a result, a single mold can serve for molding the inner cylinder and the ssembling operation can be carried out very easily. There is no possibility that, when the chuck members 24 and 24' or 55 and 55' receive the bias of the spring 10 or 66, one of the two members 24 or 24' or 55 or 55' will slide with respect to the other. The inner cylinder 8 or 63 can be inserted into the barrel through the rear end opening thereof by merely lightly pushing the former into the latter, and, when the former has once been fixed in the latter, the former can no longer come out. Therefore, even if the chuck portion 12 or 54 does not hold the lead 11 therein, the inner cylinder 8 or 63 biased by the spring 10 or 66 is prevented from moving behind the position where the protrusions 29 or 29' or 59 or 59' on the inner cylinder are engaged with and stopped by the annular projection 30 or 60 on the inner surface of the barrel 1 or 61.

In the embodiments as described hereinbefore, two chuck members 24 and 24' or 55 and 55' form the chuck portion 12 or 54 and, therefore, two tube forming member 23 and 23' or 56 and 56' integral with the members 24 and 24' or 55 and 55' are required, these members 23 and 23' or 56 and 56' being connected to each other by one connector portion 22 or 67. However, the present invention is not limited to such construction of the inner cylinder unit. For example, the chuck portion 12 or 54 may be made of three chuck members, with which three tube forming members forming the tube portion 13 or 52 are incorporated. These three tube forming members can be connected by two connector portions. Thus, it is possible to change the number of longitudinally extending tube forming members and chuck members, as well as the number of connector portions.

What is claimed is:

1. In a push type mechanical pencil comprising a barrel, an inner cylinder made of a synthetic resin and including a chuck portion and a spare leads containing tube portion communicating with said chuck portion through a lead passage, and a compression spring adapted to bias said inner cylinder rearwardly along its axis:

said inner cylinder having a hollow cylindrical body constituting at least a part of the spare leads containing tube portion, a plurality of longitudinally extending tube forming members which when they are put together constitute the remaining part of the spare leads containing tube portion, said tube forming members being integrally connected with each other by at least one bendable connector portion, one of said tube forming members being integral with the hollow molded cylindrical body, and a plurality of longitudinally separated chuck members which when they are put together constitute the chuck portion, each of said chuck members being integral with a corresponding one of said tube forming members, the cylindrical body, the divided members and the chuck members being integrally molded in a single unit;

the inner cylinder having at least one protrusion on the outer surface thereof and the barrel having an annular projection on the inner surface thereof with an inside diameter less than the maximum outside diameter which the inner cylinder has at the location of said protrusion, said protrusion on the inner cylinder and the annular projection on the barrel being adapted to engage each other when the inner cylinder is mounted in the barrel.

2. The push type mechanical pencil according to claim 2, wherein the opposed faces of said tube forming members have projections means and recess means for receiving said projection means to thereby assemble the tube forming members in an axially aligned inner cylinder.

3. The push type mechanical pencil according to claim 1, wherein the protrusion on the inner cylinder is on the outer surface of the spare leads containing tube portion.

4. The push type mechanical pencil according to claim 1, wherein the dimensions of the space between the tube forming members is so determined that the outer surface of the connector portion bent in a U-shape when the tube forming members are put together is within a circle defined by the outer surface of the hollow mold cylindrical body.

5. The push type mechanical pencil according to claim 1, wherein the hollow molded cylindrical body includes therewithin a spare leads containing chamber in the spare leads containing tube portion.

6. The push type mechanical pencil according to claim 1, wherein the protrusion on the inner cylinder is on the outer surface of the spare leads containing tube portion.

7. The push type mechanical pencil according to claim 1, wherein at least one on the protrusion of the inner cylinder and the annular projection on the barrel has an inclined surface, whereby the protrusion is depressed by the perpendicular component of a pressing force generated at the time when the protrusion is forced past the annular projection.

* * * * *